United States Patent [19]

Lin

[11] Patent Number: 4,961,276

[45] Date of Patent: Oct. 9, 1990

[54] ORNAMENTAL CRYSTAL BALL

[76] Inventor: Ming H. Lin, No. 2, Lane 429, Fu Chin St., Taipei, Taiwan

[21] Appl. No.: 206,436

[22] Filed: Jun. 14, 1988

[51] Int. Cl.[5] ..... G09F 19/00

[52] U.S. Cl. ..... 40/410

[58] Field of Search ..... 40/406, 407, 409, 410, 40/426; 446/267; 272/15

[56] References Cited

U.S. PATENT DOCUMENTS

| | | | |
|---|---|---|---|
| 3,239,956 | 3/1966 | Canonica, Jr. | 40/426 |
| 3,535,805 | 10/1970 | Peiperl | 40/406 |
| 3,593,444 | 7/1971 | Akrongold et al. | 40/426 |
| 4,490,931 | 1/1985 | Fleemin | 40/406 |
| 4,641,445 | 2/1987 | Rossi | 272/15 |

FOREIGN PATENT DOCUMENTS

| | | | |
|---|---|---|---|
| 1083064 | 9/1967 | United Kingdom | 40/410 |

*Primary Examiner*—Robert P. Swiatek
*Assistant Examiner*—Cary E. Stone

[57] ABSTRACT

An ornametnal crystal ball comprising a base, a ball mounted on the base and filled with water, a model disposed in the ball, a plurality of suspensible objects disposed in the ball and a driving apparatus to flow the water and the suspensible objects. The driving apparatus comprises a motor to drive a second magnet rotating, and then the second magnet drives a first magnet together with an impeller body to rotate. The impeller body is mounted on an upper plate of the base and in the ball, so that the rotation of the impeller body agitates the water and the suspensible objects.

1 Claim, 4 Drawing Sheets

ORNAMENTAL CRYSTAL BALL

BACKGROUND OF THE INVENTION

A conventional ornamental crystal ball is shown in FIG. 4. The conventional ornamental crystal ball comprises a base 1 and a ball 2 mounted on the base 1. The ball 2 is filled with water. A model 3 is mounted on upper surface of the base 1. Suspensible objects 4 are suspended in the ball 2. When shakes the ornamental crystal ball, the suspensive objects 4 are suspended around the model 3. It looks like a snowy scenery. Since the ornamental crystal ball is used for ornamentation, the ornamental crystal ball is always disposed on upper surface of a support means. However, for creating a snowy scenery, it is not convenient to shake the crystal ball.

It is the purpose of the present invention, therefore, to mitigate and/or obviate the abovementioned drawbacks in the manner set forth in the detailed description of the preferred embodiment.

SUMMARY OF THE INVENTION

The main objective of the present invention is to provide an ornamental crystal ball which comprises an impeller to agitate the suspensible objects.

Another objective of the present invention is to provide an ornamental crystal ball which comprises a pair of magnets. A first magnet is engaged with the impeller body and a second magnet is aligned with the first magnet and engaged with a shaft of a motor which is driven by dry batteries. The first magnet together with the impeller body is rotated by the rotation of the second magnet.

A further objective of the present invention is to provide an ornamental crystal ball which automatically agitates the suspensible objects and completely seals the water filled in the ball for preventing the water from leaking.

Further objectives and advantages of the present invention will become apparent as the following description proceeds, and the features of novelty which characterize the invention are pointed out with particularity in the claims annexed to and forming a part of this invention.

DETAILED DESCRIPTION OF THE DRAWINGS

Figure 4:
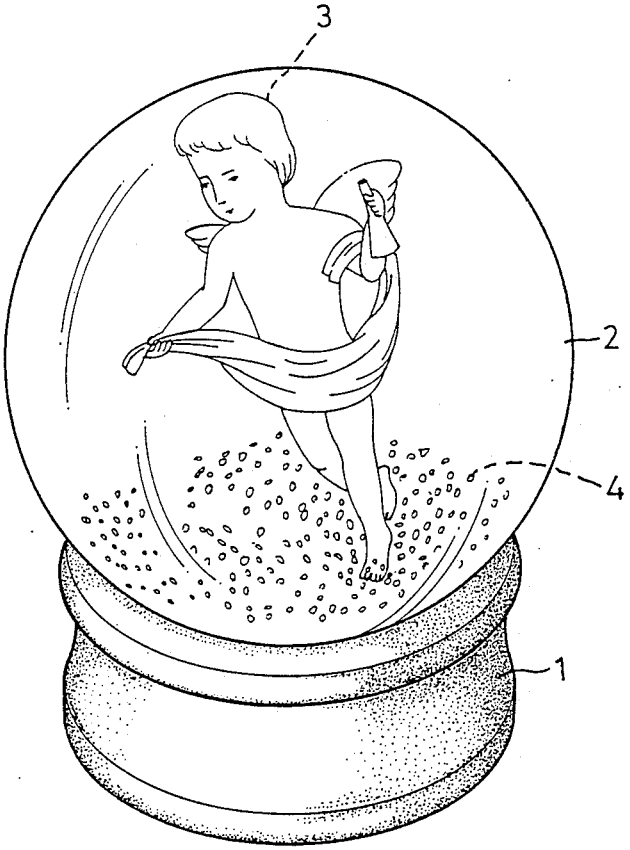
FIG. 4 PRIOR ART
FIG. 4 is a perspective view of a conventional ornamental crystal ball.

As shown in FIG. 4, a ball 2 is disposed on a base 1 and filled with water. Suspensible objects 4 are sunk in the water. It is necessary to shake the ornamental crystal ball for suspending the suspensible objects 4 around a model 3 disposed in the ball 2. For suspending the suspensible objects 4 around the model 3, it is necessary to agitate the water. If the water can be agitated by a driving means, it will be convenient for the user.

Figure 1:
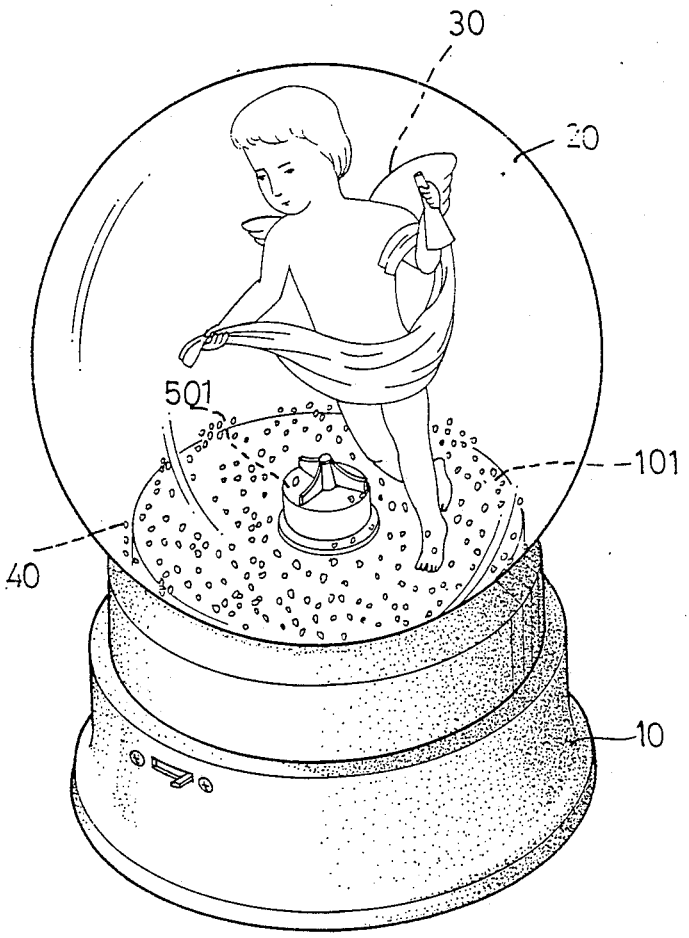
FIG. 1 is a perspective view of an ornamental crystal ball according to the present invention.
Figure 2:
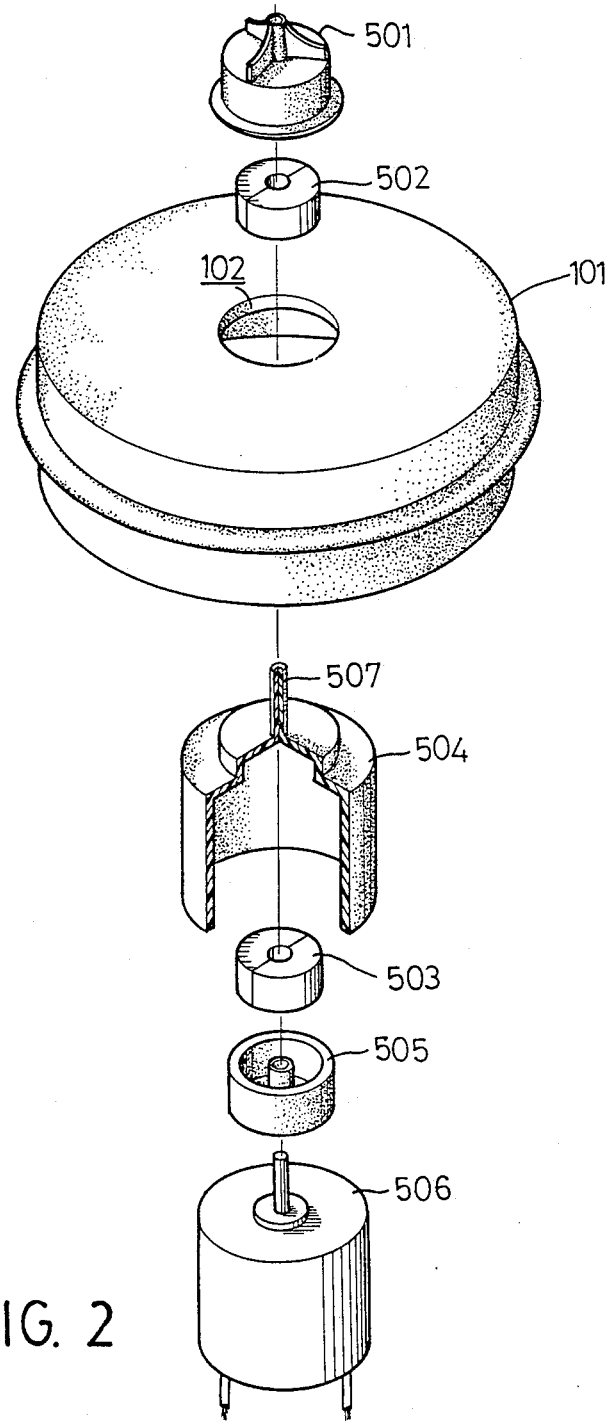
FIG. 2 is an exploded view of a driving means of the ornamental crystal ball shown in FIG. 1.
Figure 3:
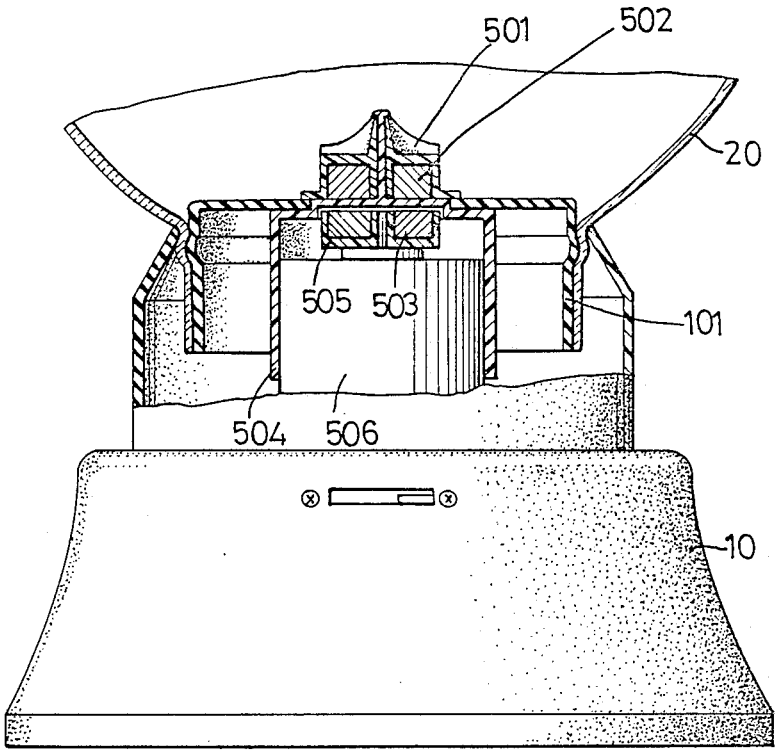
FIG. 3 is a partial cross-sectional view of the ornamental crystal ball according to the present invention, showing the driving means engaging to the ball.

A preferred embodiment is shown in FIGS. 1, 2 and 3. As shown in FIG. 1, an ornamental crystal ball according to the present invention comprises a base 10 and a ball 20 which is filled with water. A plurality of suspensible objects 40 and a model 30 are disposed in the ball 20. The ball 20 is mounted on an upper plate 101 of the base 10. An impeller body 501 is mounted on a center portion of the upper plate 101.

Referring to FIGS. 2 and 3, a driving means agitating is mounted on the upper plate 101 of the base 10 for the water filled in the ball 20. The driving means comprises an impeller body 501, a pair of magnets 502, 503, a housing 504, a carrier 505 and a driving motor 506 connecting to a power supply (not shown). The housing 504 which is made of plastic material has a upright bar 507 upwardly extending through a central hole 102 of the upper plate 101. The housing 504 can be adhered to the upper plate 101. A first magnet 502 is received within the impeller body 501 and can be adhered to the impeller body 501. The impeller body 501 and the first magnet 502 have central holes to allow the upright bar 507 to extend therethrough. The top end of the upright bar 507 is melted by heat to allow the first magnet 502 and the impeller body 501 to mount on and rotate relative to the upright bar 507. The carrier 505 receives a second magnet 503 and the carrier 504 is received in and adhered to the housing 504. The motor 506 is connected to and driven by a power supply, such as dry batteries (not shown). As shown in FIG. 1, a switch is used for controlling the rotation of the motor 506.

When the motor 506 is rotating, the second magnet 503 is driven by the spindle of the motor 506 to rotate. Although the second magnet 503 does not contact with the first magnet 502, the first magnet 502 is driven by the second magnet 503 to rotate due to magnetic force. Since the impeller body 501 is engaged with the first magnet 502, the impeller body 501 will rotate to cause the water flow, so that the suspensible objects 40 (as seen in FIG. 1) can be suspended around the model automatically.

It is noted that there is no rotating shaft or spindle extending through the upper plate 101, so that the sealing effect can be easily achieved by adhesion. The suspensible objects 40 are suspended and moved in the ball 20 without manual operation, so that the ornamental crystal ball can be stationarily disposed.

As various possible embodiments might be made of the above invention without departing from the scope of the invention. For example, in a modified embodiment of the present invention, the spindle of the motor is extended through the upper plate and engaged with the impeller body. The first and second magnets as mentioned above can be removed. The spindle is rotatable and the upper plate is fixed, so that the sealing effect between the spindle and the upper plate must be taken into consideration when manufacturing. If the water filled in the ball is leaking into the base, the components of the base will be wet and hurt, and there are air bulbs formed in the ball. For achieving perfect sealing effect, a sealing means must be arranged between the spindle and the upper plate. It is to be understood that all matter herein described or shown in the accompanying drawing is to be interpreted as illustrative and not in a limiting sense. Thus, it will be appreciated that the drawings are exemplary of a preferred embodiment of the invention.

I claim:

1. An ornamental crystal ball comprising a base, a ball filled with water and mounted on an upper plate of said base, a model mounted on said upper plate of said base, a plurality of suspensible objects disposed in said ball and a driving means for agitating the water and move the suspensible objects, wherein said driving means comprising:

a housing having an upright bar extending through said upper plate and engaging with said upper plate;

a first magnet disposed on said upright bar;

an impeller body disposed on said upright bar, said first magnet being received in and adhered to said impeller, both of said first magnet and said impeller being rotatable relative to said upright bar; and a second magnet received in a carrier engaging with a spindle of a motor, said motor being received in said housing and connecting to a power supply.

* * * * *